United States Patent [19]

Schadowski et al.

[11] 4,254,693

[45] Mar. 10, 1981

[54] PROCESS AND APPARATUS FOR MANUFACTURING SHEET PACKAGING MATERIAL FOR CONTAINERS

[75] Inventors: Werner Schadowski, Linnich; Heinrich Bellut, Myhl, both of Fed. Rep. of Germany

[73] Assignee: Jagenberg Werke Aktiengesellschaft, Düsseldorf, Fed. Rep. of Germany

[21] Appl. No.: 960,538

[22] Filed: Nov. 14, 1978

[30] Foreign Application Priority Data

Nov. 14, 1977 [DE] Fed. Rep. of Germany ..... 2750835

[51] Int. Cl.[3] ..... B31B 1/14

[52] U.S. Cl. ..... 493/60; 83/100; 83/875; 493/340; 493/228

[58] Field of Search ..... 93/58 ST, 58 R, 58.1, 93/58.4, 1 G, 58.2 R; 83/875, 100; 408/54

[56] References Cited

U.S. PATENT DOCUMENTS

| | | | |
|---|---|---|---|
| 362,180 | 5/1887 | Remus | 83/875 X |
| 3,465,625 | 9/1969 | Daly | 83/100 |
| 3,604,317 | 9/1971 | Baun | 93/58 ST |
| 3,795,164 | 3/1974 | Schneider | 83/100 X |

FOREIGN PATENT DOCUMENTS

| | | | |
|---|---|---|---|
| 118761 | 3/1901 | Fed. Rep. of Germany | 83/875 |
| 1304145 | 8/1962 | France | 93/84 FF |

*Primary Examiner*—James F. Coan

*Attorney, Agent, or Firm*—Sprung, Felfe, Horn, Lynch & Kramer

[57] ABSTRACT

In the formation of containers wherein an endless sheet material is continuously fed, finished, cut into blanks of predetermined length, and the blanks are formed into containers, the improvement wherein the finishing includes the steps of shaving off a longitudinal strip from one face of the sheet material so as to reduce the thickness of the sheet material along said strip, and removing by suction the strip shaved away. An apparatus therefor comprises a roller for supporting said sheet material, and a rotary hollow knife aligned with one longitudinal edge of the sheet material adjacent the supporting roller, the axis of rotation of the hollow knife being substantially parallel to the longitudinal edge.

5 Claims, 2 Drawing Figures

PROCESS AND APPARATUS FOR MANUFACTURING SHEET PACKAGING MATERIAL FOR CONTAINERS

BACKGROUND OF THE INVENTION

In manufacturing sheet packaging material for containers such as pouches, bags, folding boxes and the like, it is known to remove the longitudinal edge of the sheet to simplify subsequent finishing processes, such as gluing, sealing or folding of the material. In general, the longitudinal edge is thinned out by milling it, and the developing dust is vacuumed off. It is one disadvantage of this milling process that there remains some dust despite the vacuuming which might interfere with the operation of the machine, or it might also adhere to the packaging material itself and thus contaminate it, making the material useless for food packaging purposes. Another disadvantage is that the milling process is of only limited use for such materials as fibers or plastic foil for example. The milling tools become dull very quickly and must be removed and sharpened quite frequently, thus necessitating frequent machine shutdowns and finally causing higher operating costs.

SUMMARY OF THE INVENTION

It is thus one object of the present invention to provide a process and an apparatus for the manufacture of sheet packaging material for containers such as bags, pouches, folding boxes and the like, which permit the clean and dust-free removal of the longitudinal edge of such material even at extremely high feed rates.

The object of the present invention is realized by shaving that portion of the material which is to be thinned out. The shaving process is particularly efficient and exact when the packaging sheet is supported on the side to be shaved off, and is pushed downwardly on the other side of the packaging sheet by compressed air. It has been shown to be advantageous to use an air pressure of at least 3 bar, and preferably a pressure of at least 5 bar. An air pressure of 5 to 7 bar is advantageously used when the compressed air device is at a distance of less than 1 mm from the continuously advancing packaging sheet.

It has been found most advantageous to use a hollow knife with peripheral speeds of more than 10 m/s for shaving. With respect to their design, these hollow knives have been known already in the art, namely in the field of the leather processing industry, where they are usually used with manual operations. Aside from the similarity in design of these hollow knives, their operation in the two different fields of application is not comparable since different materials, different manufacturing techniques, and particularly different feed rates are used in the manufacture of sheet packaging materials for containers such as folding boxes. Thus, the feed rate of the sheet packaging material is as a rule at least 100 m/min while the longitudinal edge is being shaved off. According to the invention, even a feed rate of more than 300 m/min. is possible and does not cause any problems if the circumferential speed of the hollow knife is high enough and, in combination therewith, the packaging sheet is being pushed downwardly by the compressed air in the area of the longitudinal strip which is to be shaved off. The circumferential speed of the hollow knife is preferably greater than 15 m/s.

It can be desiraole to shave off the longitudinal strip from the packaging material, for example to make its folding easier; and in the case of composite material of paper and plastic, it is thus desirable to shave off the paper side of the material such that the more delicate plastic layer is protected during the subsequent folding process. For materials which are difficult to glue, such as the surfaces of glazed or painted cardboard, it is possible to shave off the strips which are difficult to glue and to apply the glue thereafter on that part of the longitudinal strip which has been shaved off. The process according to the invention is particularly advantageous when simple or overlapping seams in packages are to be as thin as possible to improve the tightness of the seams. Thus, the process according to the invention is especially used for shaving off the longitudinal edge of sheet packaging material used for glued or sealed folding boxes.

One preferred embodiment of the apparatus according to the invention features a rotary hollow knife in alignment with the longitudinal strip and perferably the longitudinal edge of the sheet of packaging material, the axis of rotation of said knife being approximately in the direction of feed of the sheet material. In the direction of feed of the sheet of packaging material, there is preferably directly in front of the blade of the hollow knife a supporting roller on the side of the knife, and away from the hollow knife, there is provided an air pressure nozzle on the other side of the sheet of packaging material. The air pressure nozzle is advantageously located away from the sheet material at a distance of less than 1 mm, and preferably at a distance of less than 0.3 mm. Compressed air at a pressure of 5 to 6 bar for example flows through the nozzle. According to this arrangement, the longitudinal strip, and preferably the longitudinal edge, is safely guided over the guiding roller to the blade of the hollow knife, and at the same time it is kept down by the steady, constant air pressure, thus providing a very clean cut. The quality of the cut is further improved when a rotating honing knife is fitted to the hollow knife, said honing knife preferably having a diameter which corresponds with the radius of the knife. To further improve the accuracy of the cut, it is advantageous to provide an alignment in front of the hollow knife and said guiding and pressing elements, said alignment ensuring the precise feed of the sheet material. Such alignment is provided for example by a plurality of rollers which are arranged in series on both sides of the sheet of packaging material. After passing the hollow knife, the sheet material can be guided through a grooving station.

The thickness of the shavings can be adjusted by the feed roller which is located directly in front of the cutting edge of the hollow knife. It proved to be particularly suitable to press or hold down the sheet material without any contact, merely by means of compressed air, on the side facing away from the knife. The use of air permits very high feed rates, and will not cause any mechanical damage. Also, there is no heat developing due to friction, but rather the air is being used at the same time for cooling the knives, which is important when thermoplastic material is processed. Instead of a guiding roller, smooth and easily gliding materials or rigid guiding plates may be provided, although such designs do not permit high feed rates. At feed rates of more than 100 m/min., and especially at speeds of over 300 m/min., the combination of a guiding roller on one side and compressed air on the other side is preferred.

The maximum width of the shavings is determined by the radius of the hollow knife, the bearing pressure, the type of guides and the rigidity of the sheet material. For example, at a knife radius of 60 mm, and a cardboard thickness of 0.3 mm, a strip width of more than 25 mm (and of up to 30 mm) is obtained. The shaving can be cut along the longitudinal edge or also in the center of the sheet. To ensure optimum cuts made by the hollow knife, and separation and disposal of the shavings, depending upon the material used and the feed rate of the sheet, it may be advantageous that the axis of the hollow knife is not exactly parallel to the direction of feed of the sheet but at an angle thereto, with possible angles of 5° to 10°.

The teaching of the present invention is not only applicable for continuous sheets but can be used accordingly for sheets which are already cut to size and are fed automatically. Here again, feed rates of over 300 m/min. are possible. In this application, it is furthermore important that the sheets which are cut to size and coming from the feeder are being perfectly aligned by the station provided in front of the hollow knife. The grooving tool provided behind the hollow knife provides the advantage that a groove is made at the same time alongside the shaved edge of the material in direction of the feed, such that the material can later be easily folded or doubled over.

The process according to the invention can be used for all common packaging materials for containers such as pouches, bags or folding boxes. Possible materials for such packaging sheets are for example: fiber material, plastics, foam and composite materials. Thus, in the case of a plastic-coated paper for example, the shaving can be removed from either the paper side or the plastic side, depending upon subsequent finishing processes. The process according to the invention is particularly advantageous for sheet packaging material for leakproof containers.

BRIEF DESCRIPTION OF THE DRAWINGS

A specific preferred embodiment of the process according to the invention is described in more detail with reference to the drawings, which show the shaving of the sheet packaging material for containers, and wherein.

DETAILED DESCRIPTION OF THE INVENTION

Figure 1:
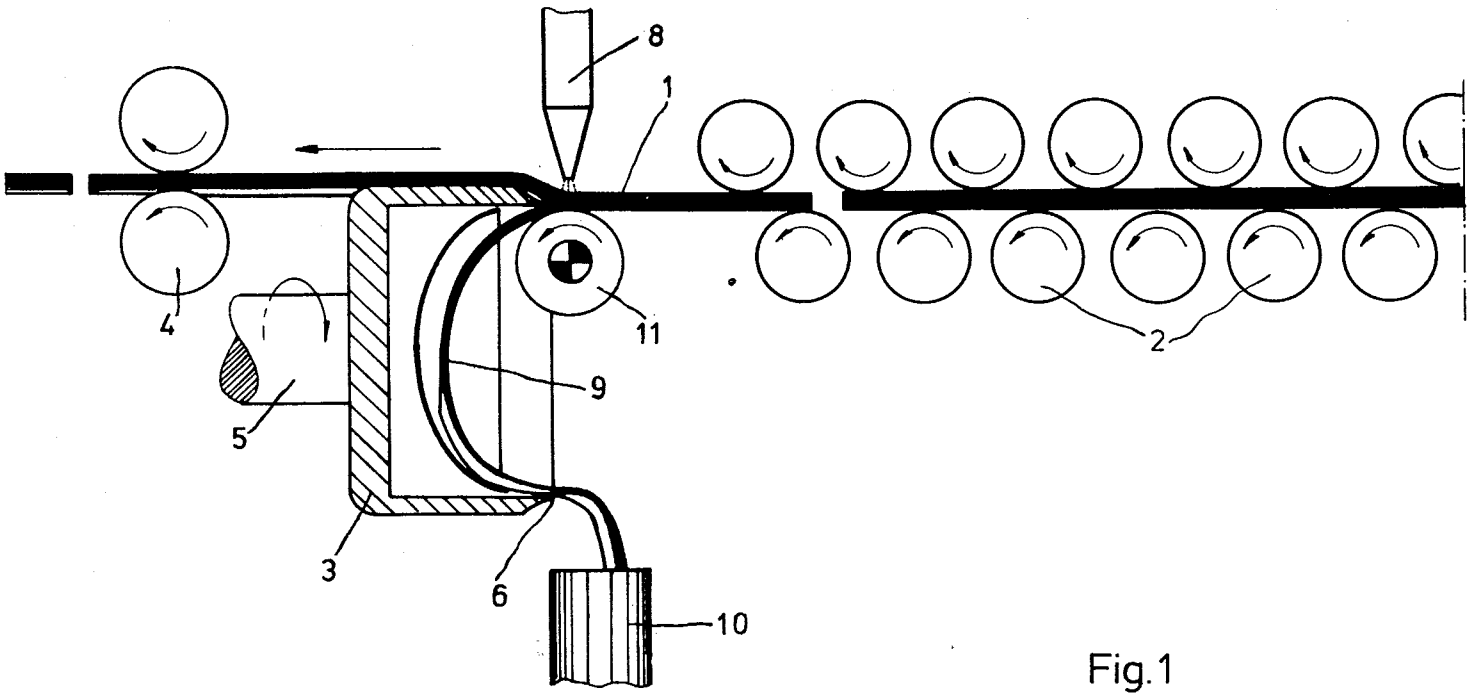
FIG. 1 is a side view and FIG. 2 is a top view.
Figure 2:
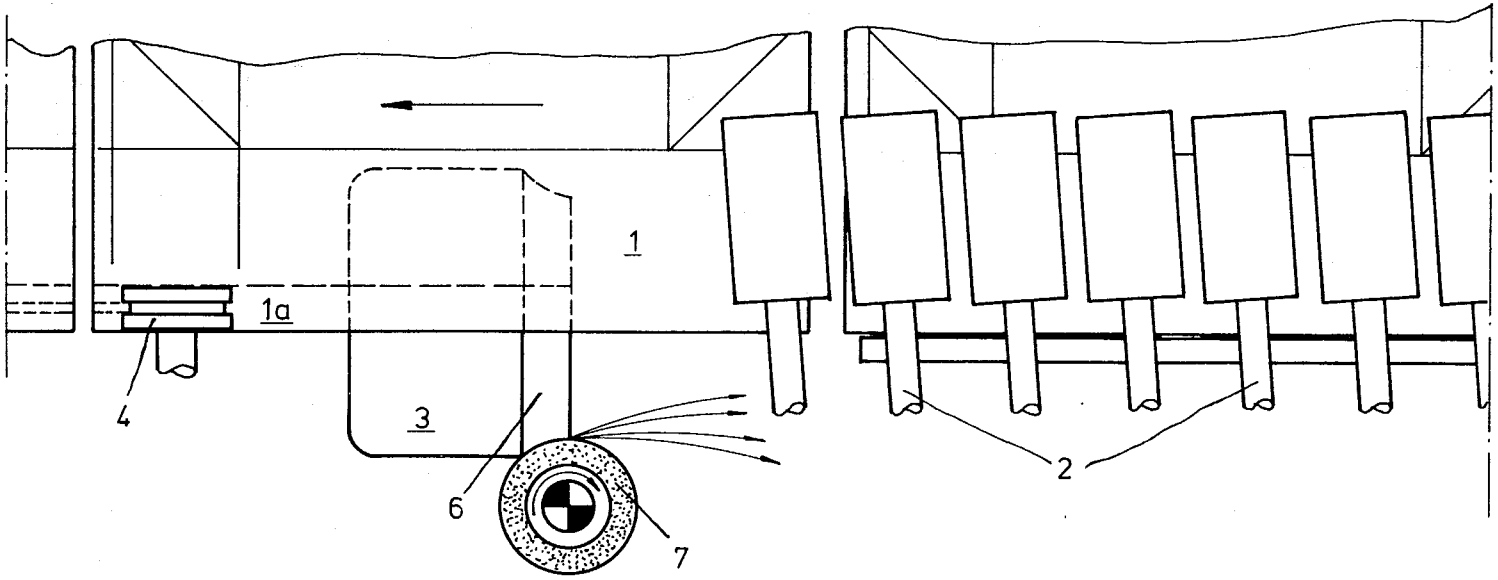

With reference to FIG. 1, the thickness of a sheet of packaging material 1 is to be reduced on one longitudinal edge. In FIG. 2, the shaved-off longitudinal edge bears the reference numeral 1*a*. More specifically, the packaging sheet 1 coming from the right in FIG. 1, consisting of separate cuttings, passes first through the alignment 2, thereafter over the rotary hollow knife 3 with that part of the longitudinal edge 1*a* that is to be shaved off, and finally passes over the grooving station 4. The axis 5 of the rotary hollow knife (bell knife) is essentially parallel with the direction of feed of the packaging sheet. The hollow knife 3 has a cutting blade 6 which comes to a point at a given radius of the knife. The knife blade 6 is continuously sharpened by means of the rotating honing wheel 7. The rotating honing wheel 7 is advantageously of a diameter which corresponds with the radius of the knife cut. To ensure that the material will rest firmly and securely against the knife edge 6 at high feed rates, there is a feed roller 11 provided directly before knife blade 6 and underneath the packaging sheet, and above the packaging sheet, there is provided a compressed air nozzle 8 at a distance of 0.2 mm from the packaging sheet. The compressed air passes through the nozzle at a pressure of 6 bar. Even at high feed rates of more than 300 m/min, this arrangement ensures that the packaging sheet 1 abuts firmly against the sharp cutting blade 6 of the hollow knife 3. The shaving 9 made by the hollow knife 3 is removed by means of the suction 10.

The manufactured sheet of packaging material is used for example for dust-free and tight packaging containers. In the top view of FIG. 2, the folding pattern of the individual packaging containers is indicated by the lines on packaging sheet 1. In folded boxes, the shaved-off longitudinal edge 1*a* permits for example that a folded edge is kept very thin in simple or even in overlapping seams, such that the tightness of the folding box is improved. To facilitate the subsequent folding processes, the grooving station 4 immediately following the hollow knife 3 cuts a groove in the center of the longitudinal edge.

The specific advantage of the apparatus according to the invention is that a specific thickness of material can be removed by a simple device, even at high feed rates and without much dust accumulating. A smooth surface is obtained across the shaved-off longitudinal strip, and sharply defined edges are formed. Very little dust develops during the shaving process which is especially important when the sheet material is subsequently used for food packages. Furthermore, it is particularly advantageous that the apparatus according to the invention permits very high production speeds, and causes no problems even at speeds of over 500 m/min. The process according to the invention is especially suitable when simple or overlapping seams of pouches, bags or boxes should be as thin as possible to make same airtight, or when other thick parts of the material are to be shaved off.

It will be appreciated that the instant specification and claims are set forth by way of illustration and not limitation and that various changes and modifications may be made thereto without departing from the spirit and scope of the present invention.

What is claimed is:

1. An apparatus for continuously finishing sheet material, comprising: means for shaving off a longitudinal strip from one face at one longitudinal edge of the sheet material to reduce the thickness of the sheet material along the edge comprising a rotary hollow knife aligned with said edge and having the axis of rotation thereof substantially parallel to the longitudinal edge; and means for supporting the sheet material during shaving comprising a roller positioned directly upstream of the tip of the blade of the knife for contacting the face to be shaved and a compressed air nozzle directed toward the opposite face of the sheet material to urge the sheet material against the hollow knife.

2. A process for continuously finishing sheet material being continuously supplied and suited for making containers, comprising: shaving off a longitudinal strip from one face at one longitudinal edge of the sheet material so as to reduce the thickness of the sheet material along said edge; supporting the sheet material, during shaving, on said one face being shaved directly upstream of the shaving while compressed air is directed against the other opposite face of the sheet material; and removing by suction the shaved off strip.

3. A process according to claim 1, wherein shaving is effected with a hollow knife at a peripheral speed of at least about 10 meters per second.

4. A process according to claim 3, wherein the hollow knife shaves at a peripheral speed of at least about 15 meters per second while the sheet material is fed at at least about 300 meters per minute.

5. In the formation of containers wherein sheet material is continuously fed and finished, the improvement wherein the finishing is effected according to claim 4, whereby the blank when folded or lapped along the line of the strip will not bulge.

* * * * *